United States Patent [19]

Carson, Jr.

[11] 3,989,132

[45] Nov. 2, 1976

[54] RIBBON STORAGE AND TRANSPORT MECHANISM

[75] Inventor: Andrew B. Carson, Jr., Waynesboro, Va.

[73] Assignee: General Electric Company, Waynesboro, Va.

[22] Filed: Aug. 26, 1974

[21] Appl. No.: 500,375

[52] U.S. Cl. ..... 197/168; 197/151; 226/197

[51] Int. Cl.² ..... B41J 33/10; B65H 23/32

[58] Field of Search ..... 197/168, 151, 170; 101/336; 226/168, 118, 119, 197

[56] References Cited

UNITED STATES PATENTS

| | | | |
|---|---|---|---|
| 344,352 | 6/1886 | Crowell | 226/197 |
| 1,021,382 | 3/1912 | Smith | 197/170 |
| 3,621,968 | 11/1971 | Kondur, Jr. | 197/151 |
| 3,758,012 | 9/1973 | Bonner et al. | 197/168 UX |
| 3,814,231 | 6/1974 | Cappotto | 197/168 |
| 3,830,351 | 8/1974 | Cappotto | 197/168 |
| 3,834,512 | 9/1974 | Haugen | 197/170 |

FOREIGN PATENTS OR APPLICATIONS

| | | | |
|---|---|---|---|
| 29,235 | 12/1913 | United Kingdom | 197/168 |
| 12,870 | 6/1913 | United Kingdom | 197/168 |

OTHER PUBLICATIONS

IBM Technical Disclosure Bulletin, "Endless Ribbon Feed," Burgers et al., vol. 7, No. 12, May 12, 1965, pp. 1212 & 1213.

*Primary Examiner*—Paul E. Shapiro
*Attorney, Agent, or Firm*—Michael Masnik

[57] ABSTRACT

The object of the invention is to provide a means of circulating inked ribbon into and out of a cartridge where it has been stored as a compact mass of ribbon folds. Means must be provided to prevent this mass of ribbon from jamming the exit port and forming clumps which result in excessive ribbon tension at the exit.

This has been accomplished by introducing a plurality of restrictors in the cartridge ahead of the exit port. In one embodiment, the first of these restrictors consists of a single dam positioned such that the mass of folded, compressed ribbon is restrained by this dam. Tension of withdrawal causes a small quantity of ribbon length to separate from the ribbon mass and cross the restrictor in small clumps or folds. The second restrictor which in one embodiment consists of two aligned dams, one above and one below, causes the ribbon to be restrained to the degree that it exits after passage as a single, unfolded ribbon under slight tension. Means are also provided for inverting the ribbon in a relatively small space inside the cartridge for simplicity purposes and to extend the ribbon usefulness and life by alternately presenting the two ribbon edges to a print head for printing purposes.

20 Claims, 9 Drawing Figures

RIBBON STORAGE AND TRANSPORT MECHANISM

BACKGROUND OF THE INVENTION

This invention relates to inked ribbon cartridges and more particularly to a cartridge for mounting in a printer or typewriter or similar machine for storing a substantial length of ribbon and delivering it in a continuous or intermittent motion for printing purposes.

In the past it has been common to store ribbon on two displaced spools, one of which operates in a take-up mode while the other operates in a supply mode, with their roles being interchangeable when the supply spool becomes exhausted.

To enable cleaner, faster, easier ribbon installation and replacement, use has been made of a cartridge arrangement wherein the ribbon is stored within the cartridge in folded form rather than being wound on reels. Since the cartridge provides a housing from which ribbon by an endless loop can be supplied and returned, one need only install the cartridge into an appropriate support on the printer to be ready for operation, thus substantially minimizing ribbon handling. Examples of such prior art ribbon handling arrangements are disclosed in U.S. Pat. Nos. 3,726,381, 3,621,968, 3,643,777 and 2,685,357.

Problems have been encountered with respect to such endless type ribbon arrangements, particularly where the ribbon is stored within the cartridge housing in folded form. In this type of arrangement the ribbon is moved in at one end of the cartridge whereupon it arranges itself into random folds before being pushed through the cartridge to an outlet end where it is withdrawn and presented to the printer mechanism for printing. In order to reduce the frequency of ribbon replacement, the ribbon capacity of the cartridge is increased by increasing the ribbon storage volume of the cartridge. In many applications, such as those involving chain or belt printers, the volume increase can best be accommodated by an enlargement of the cartridge as by elongation. Problems arise, however, because of ribbon tangling and jamming, resulting in heavy loads on the ribbon and the ribbon driving mechanism as well as on the guides used for feeding in and feeding out the ribbon. If this loading becomes excessive, the mechanism for driving the ribbon fails or the ribbon is damaged or jams, thus interfering with proper ribbon feed.

The useful life of a ribbon may be increased by use of a ribbon turnover feature, as by a mobius loop in an endless ribbon tape. While these features may be provided externally of the cartridge, it is desirable in many instances that these features be provided within the cartridge.

Summary of the Invention

Accordingly, it is an object of this invention to provide an improved ribbon storage and transport mechanism.

It is a further object of this invention to provide an improved ribbon storage and transport cartridge for use with printing apparatus.

It is a further object of this invention to provide an improved ribbon storage and ribbon inverting arrangement in a cartridge form.

It is a further object of this invention to provide improvements in stuffing an endless ribbon into an elongated reservoir and moving it to an exit port thereof for presentation for printing purposes.

It is a further object of this invention to increase ribbon cartridge capacity while minimizing the forces required to properly move such quantities of ribbon into and out of the storage cartridge.

It is a further object of this invention to provide an improved means for withdrawing ribbon stored in great density in a cartridge.

A further object of this invention is to provide an improved ribbon drive and inverting arrangement.

DESCRIPTION OF THE DRAWINGS

FIGS. 4A through 4F are schematic views of a ribbon inverting mechanism to provide a mobius loop in the endless ribbon tape wherein FIGS. 4A and 4B are top and front views respectively of this embodiment with the ribbon, whereas FIGS. 4C and 4D are front and side views of the embodiment without the ribbon, and FIGS. 4E and 4F illustrate other inverter embodiments.

DESCRIPTION OF THE PREFERRED EMBODIMENT

Figure 1:
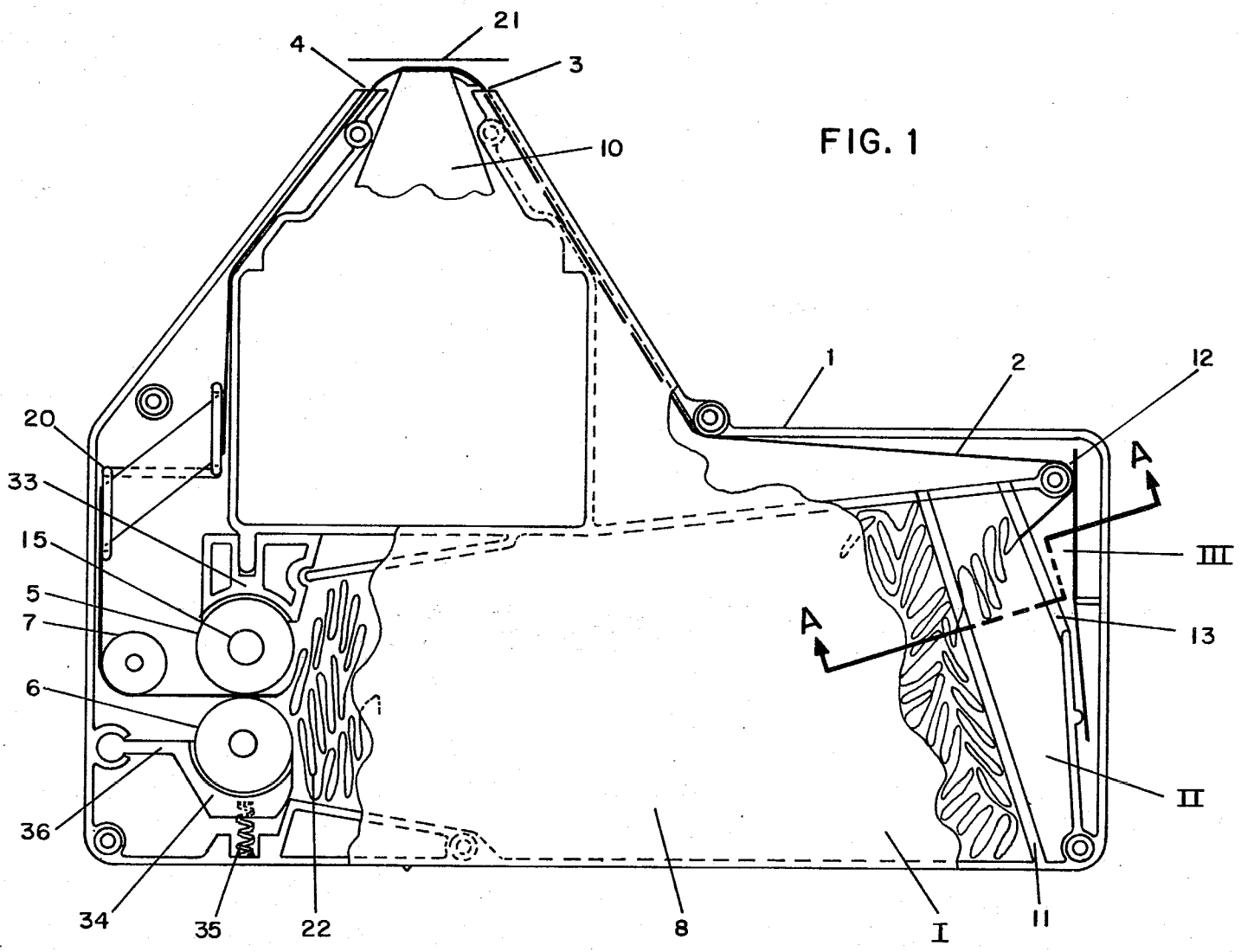
FIG. 1 is a perspective view of the ribbon cartridge (with its top side partially cut away) from which the ribbon is withdrawn and into which it is returned in a printing application.

Referring now to FIG. 1, the ribbon cartridge 1 includes a relatively elongated rectangular housing wherein the ribbon 2 is withdrawn from the ribbon outlet end 3 and returned to the cartridge at ribbon inlet opening 4. Power for pulling the ribbon is provided by drive wheel 5 in cooperation with idler wheel 6. The ribbon is guided to the drive wheel 5 by guide wheel 7. In leaving drive wheel 5 the ribbon is pushed into the cartridge housing section 8 where the ribbon arranges or settles itself into upright folds 22. In the open region between ends 3 and 4 the ribbon is presented, when mounted on a printer, to the line of the record medium 21 whereby print forming elements carried by a print head 10 cause impact against the ribbon and the record medium under the influence of these elements to form the desired characters. The inked ribbon, usually formed of a meshed material such as nylon, retains a supply of printing ink by capillary action and/or absorption. Movement of the ribbon during the printing process is desirable in order to be able to present a different portion of the ribbon for printing each character since with each printing action some of the ink is removed. It is desirable to store a maximum amount of ribbon in the cartridge and effect movement of the stored ribbon with an acceptable amount of ribbon strain. As one increases the density of ribbon in a storage cartridge, problems are encountered with ribbon jamming and high ribbon movement forces. To reduce such jamming and ribbon movement forces, Applicant divides his cartridge into three chambers or portions. Ribbon is stuffed into a first portion I, moved through this portion in relatively tight, random folds substantially under compression and into a second portion II, then sequentially withdrawn from the second portion into a third portion III and from this third portion presented to the print head. The width of the ribbon is just slightly less than the internal height of the cartridge such that the ribbon upon being stuffed into the cartridge housing in random folds can be moved therethrough with negligible edge friction. The ribbon folds are held upright by each other during packing into accordion-like pleats or folds because of the density of ribbon stored during movement through portion I.

Figure 2:
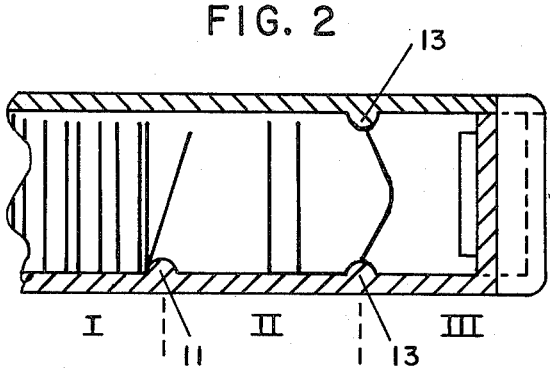
FIG. 2 is a generalized sketch and cross-section (taken along line A—A of FIG. 1) of the mechanism illustrating controlled movement of the folded ribbon by which ribbon jamming and ribbon movement forces are minimized.

Before describing in greater detail the manner in which the ribbon moves through the cartridge for presentation to a print head to effect printing, it may be well to discuss some of the problems encountered in moving a mass of random folded ribbon through such a cartridge. As previously mentioned, it is desirable to maximize the length or quantity or ribbon contained in the cartridge while minimizing the forces required to move the ribbon which factors effect ribbon slippage, wear and drive power requirements. It is also desirable to minimize the tension stresses on the ribbon which effect ribbon life. A major problem with stuffing ribbon in a cartridge in random folds is that internal pressure of the ribbon mass against the sides and exit port of the cartridge increases as the mass of contained ribbon increases. This makes it more difficult to withdraw the ribbon at the exit end of the cartridge because of proportionately higher friction involved as the extracted portion of the ribbon slides within the ribbon mass and against the walls of the cartridge. As the strength of the ribbon is finite, this friction places a limit on the amount of ribbon that may be used in a ribbon cartridge of a given configuration. While the ribbon moves in a mass of random folds within the cartridge, it is desirable to pull the ribbon from the folded ribbon mass as a single unfolded strand. However, since the pattern of ribbon folds is relatively random, oftentimes the ribbon folds are intertwined such that a large clump of folded ribbon strands present themselves at the exit port, damming the exit port and interfering with proper cartridge operation. To overcome this, Applicant teaches the use of moving the ribbon differently through the three portions I, II, and III. The border dividing the first and second portions is a restrictor or dam 11 running along either the top or bottom of the cartridge and substantially perpendicular to the direction of ribbon flow toward the exit 12. The distance between this dam and the cartridge surface opposite is less than the width of the ribbon. This dam is high enough to impede the regular flow of the ribbon mass, effectively stopping it with respect to pressure on the approach side. At the same time the dam is low enough such that a very slight pull due to ribbon tension provided by the drive wheel 5 at the exit side causes small clumps of folded ribbon to spill or pass over the dam with a tripping action. This is more clearly shown in FIG. 2. This dam or restrictor isolates the ribbon downstream of the dam from the upstream ribbon pressure and this enables the separated ribbon clump to decompress in II before being moved from portions II to III of the cartridge. This is illustrated in portion II by the larger spacing between the folds or loops shown as vertical lines. The border dividing the second and third portions of the cartridge is formed by a dam similar to the one just described plus an additional dam or ridge directly opposite it. In effect we have a double dam 13, that is one dam over another. The relatively decompressed ribbon folds or clumps attempting to leave the second portion of the cartridge under ribbon tension developed by drive wheel 5 encounter a resistance at the top and bottom edges and cannot traverse this restrictor in the trip-over fashion allowed by the first dam. The double dam thus restrains folds and clumps. However, single strands of ribbon can easily pass through the double dam by slightly bowing or skewing to accommodate to the restricted height of the passage. The effect of the double dam is thus to unfold the small folds and clumps of ribbon which accumulate transiently within the second portion of the cartridge, allowing the ribbon to be withdrawn through the dual dams as a single layer free of folds. Inasmuch as ribbon pressure within the second portion of the cartridge is extremely low compared to that existing in the first portion, the pullout force or ribbon tension at the exit is reduced greatly. The net effect of the combination of dams is therefore to isolate the unfolding function at the exit from the pressure of the upstream ribbon within the storage area I of the cartridge. This permits higher density ribbon storage, hence more ribbon in the device, before its limiting capacity is reached. Another way of looking at it is that the double dam prevents clumps of ribbon from being carried to the exit port by holding the separated, decompressed clumps in an intermediate reservoir while permitting a single strand from the clumps to be withdrawn into the exit port. It is this combination of a single dam for breaking the ribbon up into small clumps followed by a double dam to enable the withdrawl of ribbons from the separated clumps as a single strand that constitutes one feature of the present invention. The problem with using a restrictor like 13 alone is that, while it may release the ribbon in a single strand, it does so under conditions of relatively high pressure of the ribbon mass against the restrictor and against itself with the result that friction induces very high peak tension pullout forces which can be reduced only be reducing the mass of contained ribbon. Also, if a particularly large mass of folded ribbon attempts to pass through the restrictor under high pressure, the ribbon mass wedges or jams at the restrictor resulting in blockage of ribbon flow. The problem with using a restrictor like 11 alone is that while clumps of multiple folds of ribbon may pass through the dam without excessive ribbon tension, these clumps jam the exit port of the chamber resulting in excessive ribbon tension or blockage of ribbon flow.

Figure 3:
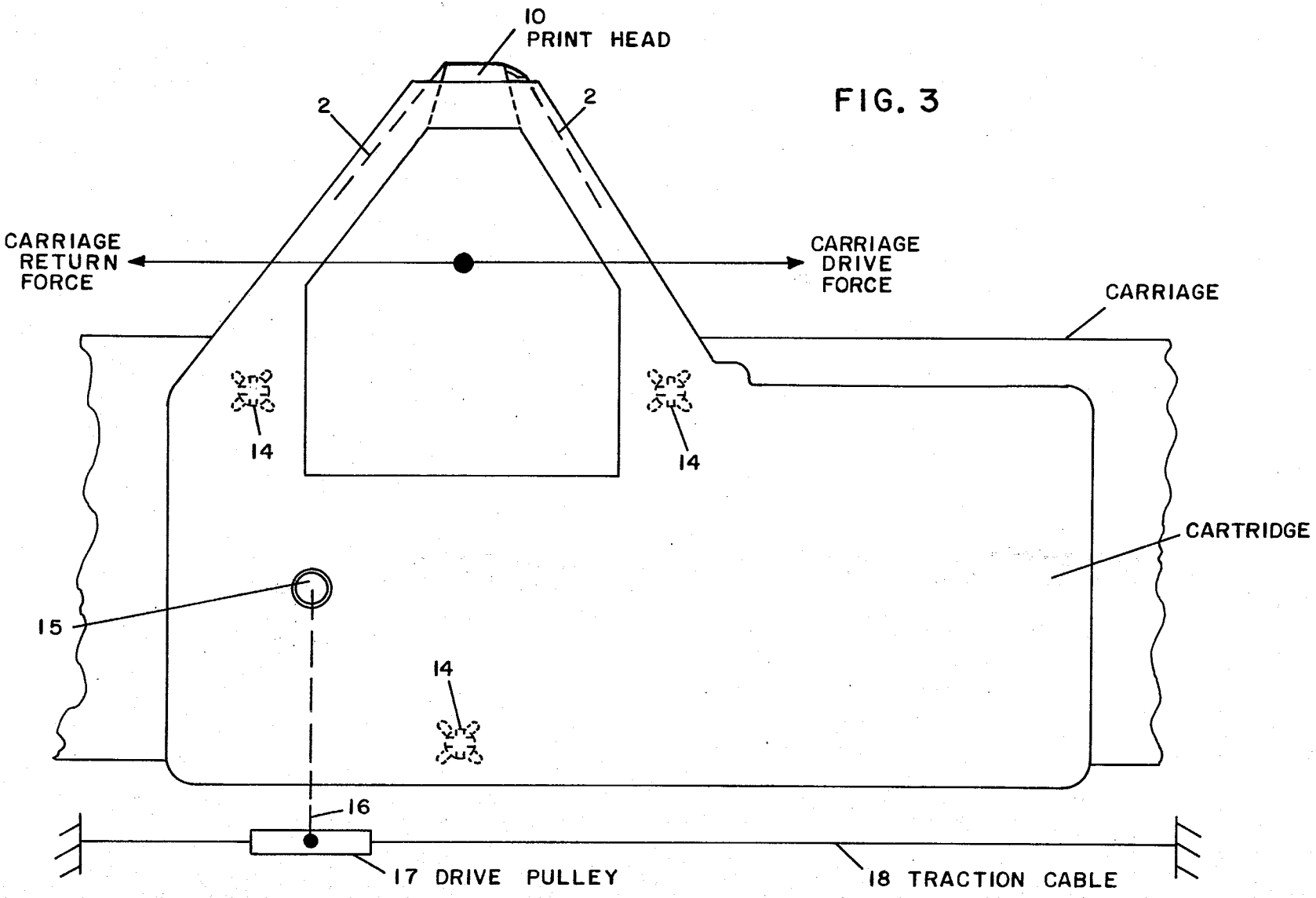
FIG. 3 is a generalized sketch of one embodiment in which the cartridge of FIG. 1 is mounted on a moving print head carriage and the ribbon driven during a printing operation.

The cartridge as described is especially shaped to fit over the print head 10 in a way which not only facilitates installation but also permits maximum visibility of the characters being printed. It is supported mechanically by three snap fasteners 14 (shown as X's in FIG. 3) which engage three corresponding sockets, not shown, in the carriage carrying the print head. In its installed position the cartridge surrounds the rear-most portions of the print head 10 and extends forward to within a short distance of the order of ½ inch of a record medium such as paper. From this point the ribbon emerges from the right side, passes over the print head for printing and re-enters the cartridge on the other side. The aforementioned clearance of ½ inch insures that the cartridge parts do not interfere with print visibility.

To put the cartridge in place, the ribbon is first drawn taut across the openings between the inlet and outlet ends 3 and 4 of the cartridge. A knob 15 on the shaft of the driving pinch roller 5 is provided to make this possible. The cartridge is held forward and lowered over the print head far enough such that the taut, exposed section of ribbon slides down and onto the nose of the print head. It is then withdrawn the approximate ½ inch previously noted and the fasteners on the cartridge snapped into the receptacles provided for on the carriage. In the process of the final positioning, the drive shaft 16 on the carriage is aligned with 15 with the driving pinch roller and engages it via a spline arrangement. Raised edge guides on the print head assure proper vertical positioning of the ribbon. Removal of a cartridge is even simpler, all one does is lift to disengage the snap fittings and continue lifting until the cartridge is completely free of the printer. At no time in either the installation or the removal process is it necessary for an operator to touch or place fingers near the exposed portion of the inked ribbon.

The drive shaft 16 is carried by the carriage assembly and in one embodiment is driven by a pulley 17 around which a traction cable 18, secured to stationary points at each end, is wrapped one turn. Thus when the carriage moves, the pulley rotates. For further details of a pulley drive mechanism, reference can be made to copending application of John Raymond Bittner, Ser. No. 423,734, filed Dec. 11, 1973 and assigned to the common assignee. In this arrangement the pulley and the shaft are separated by an overrunning clutch which permits the shaft to be driven in one direction only so that the ribbon moves across the print head only when printing occurs, that is during left to right carriage motion but not during the return right to left motion. Thus fresh ribbon is always being passed over the print head during printing operations.

Figure 4A:
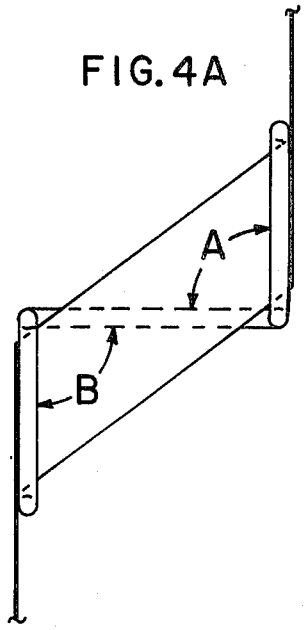
Figure 4C:
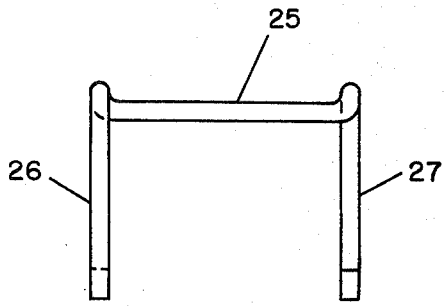
Figure 4B:
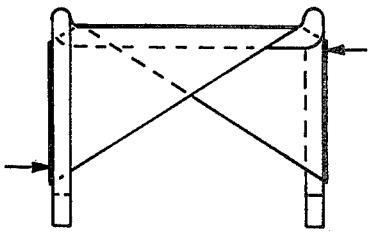
Figure 4D:
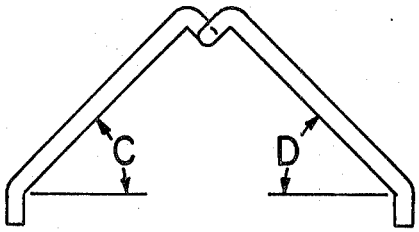
Figure 4E:
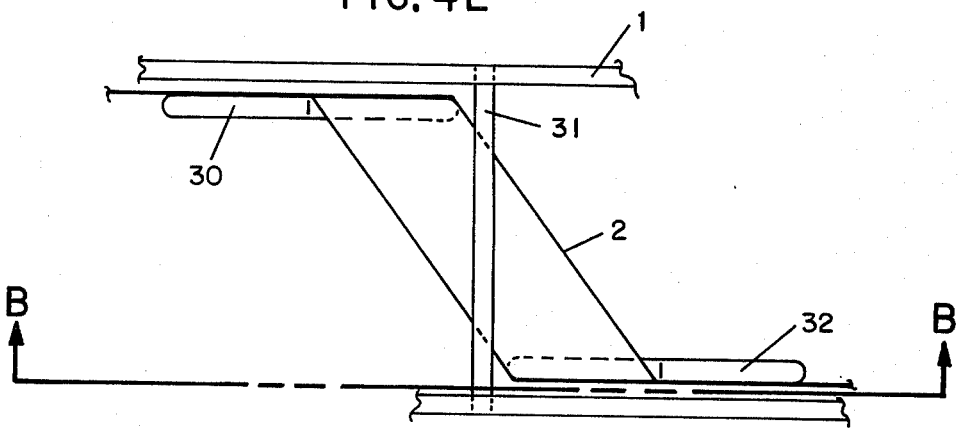
Figure 4F:
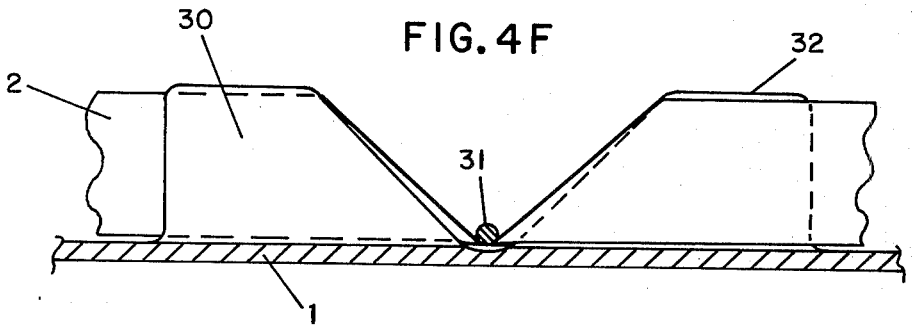

In order to make better use of the ribbon, a ribbon inverting mechanism 20 is included in the cartridge which form a mobius loop to invert the ribbon and present first one edge and then the other edge of the ribbon to the recording medium for printing by the print head. To accomplish this inversion within a small space and in a manner which entails a minimum of sliding friction when the ribbon is pulled through the inverter mechanism, the arrangement of FIG. 4 is used. The usual method of inverting (or creating a 180° twist or spiral in the ribbon) has been to make a gradual, continuous spiral transition between parallel rollers or other supports. This requires space that is not always available and entails the danger that the twist so created will migrate away from the intended twist area into a following area in which it becomes troublesome. If the points of support are brought closer together, the danger of migration is increased and the ribbon is also subjected to stretch stresses at its edges which must travel a greater distance than at its center. It is possible to accomplish this inversion without stretching by causing the ribbon to pass over a succession of plane-shifting guides. Because the total friction of ribbon in changing direction is an exponential function of the total contact angle involved in sliding, it is important to minimize total sliding angular contact to prevent friction from becoming excessive. To accomplish inversion the arrangement of FIG. 4 shifts the plane of the ribbon three times with the total angular contact being 180° or less. The migration problem previously described is avoided. FIGS. 4A and 4B are top and front views of the inverter loaded with ribbon. FIGS. 4C and 4D are top and side views of the inverter shown without ribbon loading. The inverter portions 25–27 may be formed of any smooth, rigid material. In one preferred embodiment, the inverter comprised a wire clip bent into a configuration shown as a cross piece 25 held by two legs 26 and 27 which are supported in holes formed in the base of the cartridge. In its most compact form angles A and B will be 90° and angles C and D 45° and the angle of ribbon contact at each of the three planar transitions shown in FIG. 4 will be 60° of arc in the direction of ribbon travel, or a total of 180° for the inversion. Angles C and D may be reduced below 45° and angles A and B increased above 90° interdependently, and the total contact angle will be reduced although more space is required if this adjustment is made. FIGS. 4E and 4F illustrate one of the many alternate devices within the spirit of this invention which will perform the same inversion. FIG. 4E is a top view and FIG. 4F is a side view. The ribbon 2 is caused to be bent over the downward sloping edge of the inverter leg 30, pass under the cross arm 31 and be bent over the upward sloping edge of the inverter leg 32. The legs 30 and 32 are molded from cartridge casing material in the form of wedges rather than the wire of FIGS. 4A through 4D. The arm 31 is formed of wire which may be inserted in the base of the cartridge or may be an integral projection from the top of the cartridge depending on inverter orientation.

In FIG. 1, 33 operates as a journal or bearing for driving wheel 5 as well as serving to cause the ribbon to peel off the wheel into the housing 8 for storage rather than wind back around the wheel to its entrance side. In a similar manner 34 acts as a combination journal or bearing for idler wheel 6 and insures ribbon retention in housing 8. Idler wheel 6 is biased against driving wheel 5 by spring 35 which urges journal 34 against wheel 6. Journals 34 and 33 may be molded as part of the cartridge plastic material with journal 34 resiliently pivoted about arm 36 to insure the desired biasing action. In one preferred embodiment wheels 5 and 6 included 3 tiered gears which drive the ribbon into housing 8 with the gears being undercut to mate with corresponding protrusions in journals 33 and 34 in which they rotate.

It will be appreciated that modifications may be made in the various structures disclosed in order to produce or to carry out the present invention. Of course, modifications of some of the specific steps cited in describing embodiments of the invention will occur to those skilled in the art. All such modifications which come within the spirit and teachings of this disclosure are intended to be covered by the following claims.

What I claim as new and desire to secure by Letters Patent of the United States is:

1. An inked ribbon cartridge for a printing device comprising an endless ribbon, a housing for storing the major portion of said ribbon, said housing having first and second restrictors dividing the housing into first, second and third portions, a ribbon inlet at one end of said housing and a ribbon outlet at another end of said housing, means for withdrawing ribbon under tension from the outlet and for feeding it to the inlet, said housing having an internal height slightly higher than the width of said ribbon and being of sufficient length such that incoming ribbon arranges itself into folds without tumbling, means for causing folded ribbon to be compressed in said first portion comprising said first restrictor located between said first and second portions for impeding transfer of ribbon from said first to said second portions in response to said means for feeding, means for separating clumps of multiple folds of ribbon from said first portion and decompressing such separated clumps in said second portion comprising said ribbon being in a sufficient amount and said first restrictor being dimensioned such that portions of the compressed ribbon are caused to respond to ribbon tension and trip across the restrictor in clumps into the second portion where the clumps are decompressed, said second restrictor located between said second and third portions for impeding transfer of separated, decompressed clumps of ribbon from said second to said third portion in response to said means for feeding, and means for enabling ribbon to be withdrawn from said second portion into said third portion as an unfolded strand of ribbon comprising said second restrictor being dimensioned such that the ribbon responds to ribbon tension to bow and/or skew along its width in order to pass the second restrictor.

2. An arrangement according to claim 1 wherein said first restrictor comprises a dam located inside the cartridge substantially transverse to the movement of ribbon flow through the housing, said second restrictor comprising a pair of aligned dams located inside the housing, substantially transverse to the movement of ribbon flow through the housing, said first mentioned dam being dimensioned such that portions of compressed ribbon are caused to trip over such dam in clumps in response to ribbon tension, said pair of dams being dimensioned such that the ribbon is bowed and/or skewed along its width into an unfolded strand in passing between the dams.

3. An arrangement according to claim 2 wherein said means for withdrawing and feeding ribbon comprises a pair of pinch rollers.

4. An arrangement according to claim 1 further comprising means for tensioning said ribbon upon withdrawal from said third portion, said tensioning means comprising a leaf spring operating against a capstan and means for drawing said ribbon against the spring pressure of the spring against said capstan.

5. An arrangement according to claim 1 wherein said cartridge has an inlet guide and an outlet guide separated by a gap for directing the ribbon from the inlet to the outlet across said gap, said cartridge being designed to receive a print head at the gap for causing printing with the portion of the ribbon exposed in the gap.

6. An arrangement according to claim 5 wherein said means for withdrawing comprises a pair of pinch rollers, a knob provided on one of said pinch rollers for manually changing the amount of ribbon available at said gap.

7. An arrangement according to claim 5 for use with a carriage carrying said print head across a line of print on a record medium wherein said cartridge comprises detent means for providing a rapid attachment and detachment of the cartridge with respect to said carriage.

8. An arrangement according to claim 1 comprising means for imparting a 180° twist to the ribbon, said means comprising a pair of legs connected by an arm, means for bending the ribbon around a first leg, then around an arm, and finally around the second leg.

9. An inked ribbon cartridge for a printing device comprising an endless ribbon, a housing for storing the major portion of said ribbon, said housing having a plurality of restrictors positioned transverse to and spaced apart along the direction of ribbon flow, means for causing ribbon to flow in said housing from one end of said housing to another end of said housing comprising means for withdrawing ribbon from one portion of said housing under tension and for feeding it into a second portion of said housing means for causing ribbon to flow in said first portion in a relatively dense mass of random folds under compression in response to said means for feeding comprising a first one of said restrictors, means for separating clumps of multiple folds of ribbon from said first portion for decompression of such separated clumps in a second portion of said housing comprising said first restrictor positioned substantially transverse to the movement of ribbon flow through said housing and at the boundary of said first and second portions, means for enabling ribbon to be withdrawn from said second portion into a third portion of said housing as an unfolded strand of ribbon comprising a second one of said restrictors positioned substantially transverse to the movement of ribbon flow through said housing and at the boundary of said second and third portions said ribbon being in a sufficient amount in said first portion of said housing and said first restrictor being dimensioned to cause portions of said ribbon to pass across said restrictor as clumps of multiple folds of ribbon, said second restrictor dimensioned to enable ribbon passage across said restrictor as a single strand but not as clumps of multiple folds of ribbon.

10. An inked ribbon cartridge for a printing device comprising a housing, said housing comprising first, second and third portions, a ribbon, means for moving said ribbon successively through said first, second and third portions, means for moving ribbon in said first portion as a relatively large mass of random folded ribbon under compression, means for moving ribbon in said second portion as a relatively small mass of decompressed, folded ribbon comprising a first restrictor positioned at the junction of said first and second housing portions, said ribbon being of a sufficient amount and said restrictor being dimensioned to cause ribbon passage through said first restrictor in such relatively small mass of ribbon, and means for moving ribbon under tension in said third portion as a single strand but not as a mass of folded ribbon comprising a second restrictor.

11. An arrangement according to claim 10 wherein said first and second restrictors are positioned transverse to and spaced apart along the direction of ribbon flow in said housing.

12. An inked ribbon cartridge for a printing device comprising a housing, an endless loop of ribbon, said housing comprising first, second and third portions for housing said ribbon, means for pulling said ribbon successively through said first, second and third portions, means for restraining movement of ribbon in said first portion to form it into a relatively large mass of random folded ribbon under compression, means for separating ribbon from said mass of ribbon in said first portion into clumps of folded ribbon for decompression in said second portion comprising said first restrictor located in said housing and defining the boundary between said first and second portions, said ribbon being in a sufficient amount in said first portion of said housing and said first restrictor dimensioned to cause portions of the compressed ribbon to detach itself in clumps in passage across said first restrictor, and means for separating ribbon from said clumps in said second portion into a single strand in said third portion comprising said second restrictor located in said housing and defining the boundary between said second and third portions.

13. An arrangement according to claim 12 wherein said first restrictor is dimensioned to cause said ribbon in said first portion to respond to ribbon tension developed by said ribbon pulling means to trip across said restrictor in clumps of ribbon into said second portion, and said second restrictor is dimensioned to cause a strand of ribbon to bow and/or skew along its width across said restrictor into said third portion.

14. A ribbon cartridge for a ribbon utilization device comprising; an endless loop of ribbon, a housing, said housing comprising first, second and third portions, means for moving said ribbon successively through said first, second and third portions, first restrictor means for restraining ribbon movement in said first portion to form the ribbon into a relatively large volume of folded ribbon under compression in said first portion, means for controlling ribbon movement from said first portion to said second portion in a manner to form relatively small clumps of folded but decompressed ribbon in said second portion, comprising said ribbon being of a sufficient amount and said first restrictor being dimensioned to cause ribbon passage through said first restrictor in such clumps, second restrictor means for controlling ribbon movement from said second to said third portion as a single strand, and means for applying said strand of ribbon to said utilization device.

15. A ribbon cartridge comprising a housing, an endless loop of ribbon, said housing comprising first, second and third portions for housing at least a portion of said ribbon, means for pulling said ribbon successively through said first, second and third portions, means for restraining movement of ribbon in said first portion to form it into a relatively large mass of random folded ribbon under compression, means for causing ribbon to be pulled from said mass of ribbon as a clump of relatively decompressed, folded ribbon into said second portion comprising said first restrictor located in said housing and defining the boundary between said first and second portions, said ribbon being compressed in a sufficient amount in said first portion of said housing and said first restrictor being dimensioned to enable the compressed ribbon to detach itself in such a clump in passage across said first restrictor, and means for causing ribbon to be pulled from said clump as a single strand into said third portion comprising said second restrictor located in said housing and defining the boundary between said second and third portions.

16. Apparatus for imparting a 180° angular rotation about its longitudinal axis with minimal friction to a moving ribbon having an inlet longitudinal direction of movement and an outlet longitudinal direction of movement substantially parallel to one another comprising means for angularly rotating the ribbon 180° about its longitudinal axis within three discrete stages, said means consisting of a respective guide for each of said stages, one of said guides positioned with respect to said other guides to impart a component of change of longitudinal direction of ribbon movement between said inlet and outlet directions, and means for causing the ribbon to undergo a respective change in direction of such longitudinal movement about each of said stages, wherein the total change in such direction is 180° or less.

17. An arrangement according to claim 16 wherein each of said guides comprises a longitudinal axis about which the ribbon is angularly rotated.

18. An arrangement according to claim 17 wherein each of said axes are mutually perpendicular to one another.

19. An arrangement according to claim 17 wherein a pair of the axes are skewed relative to one another in a V shape and spaced apart laterally of the direction of ribbon movement with the third axis connecting the pair of axes adjacent to but spaced from ends of the axes near their V point such that the ribbon may move partially around and under a first axis of said pair, over said third axis and under and partially around the second axis of said pair.

20. A ribbon guide for a ribbon cartridge, means for imparting substantially a 180° inversion to the ribbon with a minimum of sliding friction and in a relatively small space comprising three ribbon shifting guides, each guide having a longitudinal axis about which the ribbon is angularly rotated during its movement, the axis of a first guide being positioned at substantially a 45° angle to a reference plane, the axis of a second guide being positioned at substantially a 135° angle, to said reference plane and said third guide separating said first and second guides and being positioned perpendicular to each of said first and second guides near their ends furthest from said reference plane and parallel to said reference plane.

* * * * *

UNITED STATES PATENT OFFICE

CERTIFICATE OF CORRECTION

Patent No. 3,989,132 Dated November 2, 1976

Inventor(s) Andrew B. Carson, Jr.

It is certified that error appears in the above-identified patent and that said Letters Patent are hereby corrected as shown below:

Col. 4, line 40, cancel "be" and insert -- by --

Col. 9, line 39, cancel "compressed"

Col. 9, line 41, cancel "enable" and insert -- cause portions of --

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*